United States Patent [19]

Salmon

[11] 4,274,611

[45] Jun. 23, 1981

[54] DEVICE FOR THE DETECTION OF THE POSITION OF A RAILWAY VEHICLE

[75] Inventor: Jean Salmon, Aulnay Sous Bois, France

[73] Assignee: Jeumont-Schneider, Puteaux, France

[21] Appl. No.: 54,818

[22] Filed: Jul. 5, 1979

[30] Foreign Application Priority Data

Jul. 17, 1978 [FR] France ..... 78 21169

[51] Int. Cl.[3] ..... B61L 25/02

[52] U.S. Cl. ..... 246/34 R; 246/63 R; 246/249

[58] Field of Search ..... 246/122 R, 34 R, 34 CT, 246/63 R, 63 A, 63 C, 182 B, 187 B, 167 R, 249; 340/23; 364/424; 180/131

[56] References Cited

U.S. PATENT DOCUMENTS 3,201,583 8/1965 dit Rolle ..... 246/63 R X 3,609,676 9/1971 Jauquet et al. ..... 246/187 B X

*Primary Examiner*—J. D. Miller

*Assistant Examiner*—Reinhard J. Eisenzopf

*Attorney, Agent, or Firm*—Schwartz, Jeffery, Schwaab, Mack, Blumenthal & Koch

[57] ABSTRACT

In a train control system wherein emitter beacons are located at predetermined points on the track near to one of the running rails, a device for detecting the position of a vehicle running on the railway track. It comprises into each beacon a radiating vertical-axis coil powered by an alternating current of a given frequency and, on board the vehicle, near to the corresponding rail, a pick-up unit including two pairs of receiver coils the axes of which are horizontal and perpendicular to the running rails. The associated circuits comprise two differential amplifiers connected to at least to two band-pass filters and a multiplier circuit in order to generate a positive signal when and only when the beacon is located between the two pairs of coils and the frequency of the beacon is the central frequency of the filters.

6 Claims, 7 Drawing Figures

DEVICE FOR THE DETECTION OF THE POSITION OF A RAILWAY VEHICLE

FIELD OF THE INVENTION

The present invention refers to a device for the detection of the position of a railway vehicle with respect to the track, this device being accurate and selective, that is to say, both responsive to the signals transmitted by an emitter beacon arranged on the track and unresponsive to the signals proceeding from other beacons or interference signals.

SUMMARY OF THE INVENTION

The device for the detection of position in accordance with the invention is characterized in that it includes:

- at least one emitter beacon including a generator of alternating current and a coil having a vertical axis, located at a predetermined point on the track, near to one of the running rails;
- on board each vehicle, near to one of the rails, two groups of two receiver coils the axes of which are horizontal and perpendicular to the running rails, the two coils of each group being connected in accordance with a differential system to the inputs to a differential amplifier;
- at least one filter circuit and detection unit connected to the outputs from the differential amplifiers, each unit including two bandpass filter circuits, the central frequency of which is equal to the frequency of a beacon, each filter circuit being connected to the output from a differential amplifier;
- a circuit for multiplication of the output signals from the filter circuits; and
- circuits for detection and comparison with a predetermined threshold, of the output signals from the multiplication circuit in order to deliver a logical signal representative of the presence of the said beacon.

The four receiver coils are arranged, for example, in the same cabinet as the pick-up of the track circuit signals or any other information pick-up.

The device for the detection of position in accordance with the invention is insensitive to any current passing through the running rails. It delivers a logical signal which enables very accurate location of the vehicle with respect to the railway track. This logical signal may be employed for realizing accurate control of the driving of the vehicle.

A detailed description of the invention is given below.

BRIEF DESCRIPTION OF THE DRAWINGS

This description is illustrated by the attached Figures which represent.

DETAILED DESCRIPTION

Figure 1:
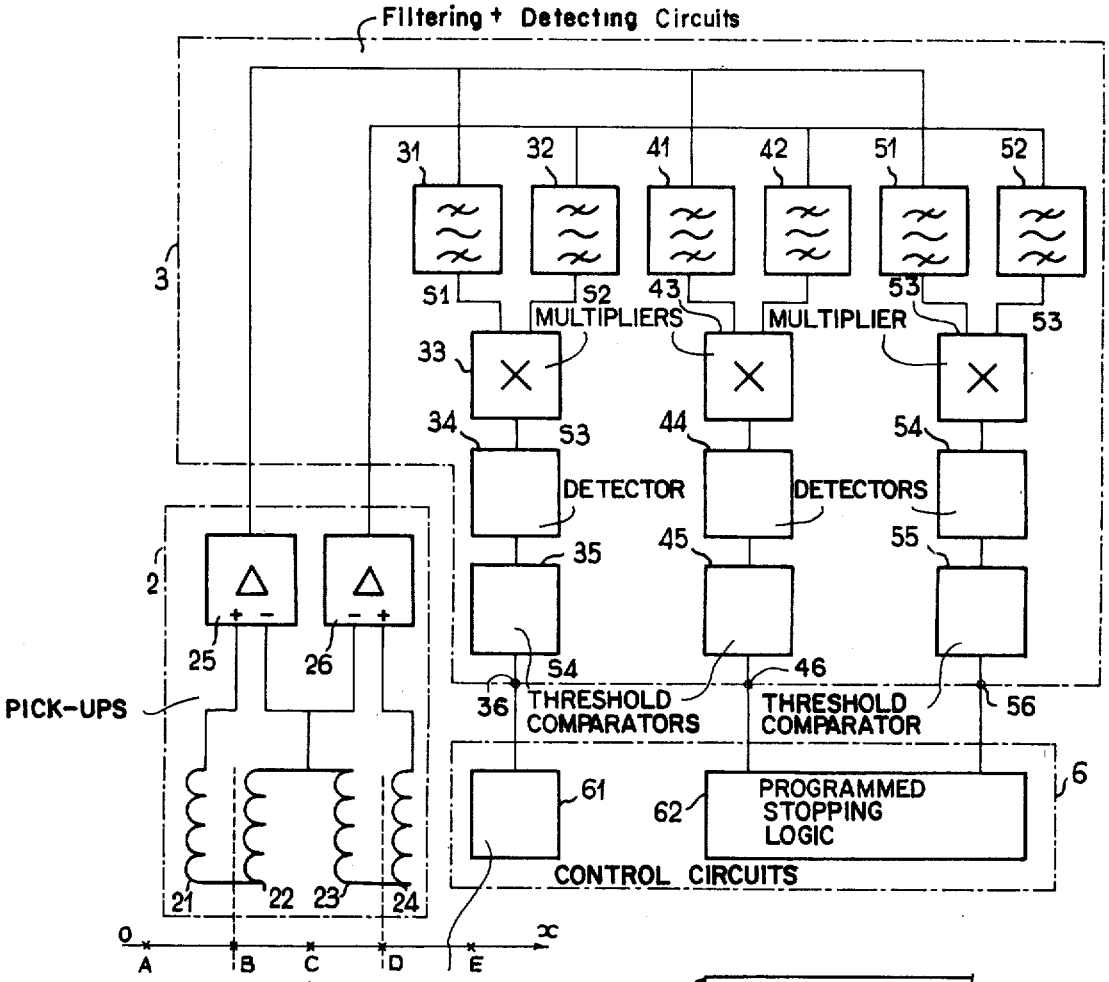
FIG. 1—a block diagram of the detector device in accordance with the invention.

The block diagram of the device for the detection of position in accordance with the invention is represented in FIG. 1. An emitter beacon 1 is arranged at the edge of the track at a predetermined point close to one of the running rails. The track is symbolized by an axis OX. The beacon 1 comprises a generator of alternating current connected to a coil having a vertical axis, which radiates an alternating magnetic field of predetermined frequency. The frequency of transmission lies, for example, between 10 kHz and 50 kHz.

The means of reception on board the vehicle include two essential portions: a first portion 2 comprises the pick-ups proper and a second portion 3 comprises the filtering and detection circuits which enable logical signals to be delivered to control circuits 6 of the vehicle.

The pick-up 2 on board the vehicle comprises two groups of two receiver coils the axes of which are horizontal and perpendicular to the running rails. The two coils 21 and 22 of a first group are connected in accordance with a differential system to the two inputs to a differential amplifier 25. The two coils 23 and 24 of the second group are likewise mounted in accordance with a differential system at the inputs to a secnd differential amplifier 26. The axes of all the coils are located substantially in one and the same horizontal plane. The two coils 21 and 22 of the first group are located very near to one another.

The coils 23 and 24 likewise very near to one another, are located slightly to the rear with respect to those of the first group.

The points A,B,C,D,E, on the axis OX represent five possible positions of the axis of the beacon 1 with respect to the pick-up 2. These positions serve to explain the invention and are employed likewise in FIGS. 4,5,6 and 7.

The output signals from the amplifiers 25 and 26 are applied to the second portion 3 of the device for the detection of position. The latter comprises by way of example three filtering and detection units. Each unit is intended for the detection of signals from a beacon of predetermined frequency. The first unit comprises two bandpass filter circuits 31 and 32, connected respectively to the outputs from the amplifiers 25 and 26. The central frequencies of the filters 31 and 32 are equal, for example, to 20 kHz. The outputs from these filters are connected to the inputs to a multiplication circuit 33. The output from circuit 33 is applied to a detector circuit 34 which preserves only the amplitude envelope and then is followed by a threshold comparator circuit 35. The comparator 35 delivers a logical signal S4 to an output terminal 36 connected to the control logic of the vehicle 6. Under the circumstances it is a question, for example, of a logic 61 for initiating coasting.

The two other filtering and detection units are similar to the first and differ from it only in the central frequency of the filtering circuits. Thus the second unit includes two bandpass filters of central frequency 25 kHz, referenced 41 and 42 and connected respectively to the amplifiers 25 and 26. A multiplier 43 is connected to the outputs from the filters 41 and 42 and is followed by a detector 44 and then a threshold comparator 45 which delivers to a terminal 46 a second logical signal. The third unit includes similarly filters 51 and 52 of central frequency 30 kHz, connected likewise to the amplifiers 25 and 26. These filters are followed respectively by a multiplier 53, a detector 54 and a threshold comparator 55 which delivers a third logical signal to a terminal 56. It may be assumed that the logical signals delivered to the terminals 46 and 56 are applied to a logical circuit for programmed stopping 62, for example, in the control logic of the vehicle 6.

When the beacon 1 is located in front of the pick-ups 2, for example, at the level of the point A on the axis OX, the coil 21 is subjected to a magnetic field higher in amplitude than that in the coil 22. Similarly the coil 23 is subjected to a magnetic field higher than that in the coil 24. Hence the groups of coils 21 and 22 on the one hand and 23 and 24 on the other deliver to the differential amplifiers 25 and 26 respectively induced differential voltages in phase opposition. The same applies when the beacon is lying at the level of the point E, that is to say, to the rear of the pick-ups 2. It is only when the beacon is lying within the zone located between the points B and D that the coils 22 and 23 are subjected to a field higher than those in the coils 21 and 24. Under these conditions the groups of coils deliver induced differential voltages in phase. The filters 31-32, 41-42, 51-52, distinguish the type of beacon picked up. Hence the product of the signals proceeding from each group of coils indicates by its sign the position of the beacon with respect to the group of coils.

Figure 2:
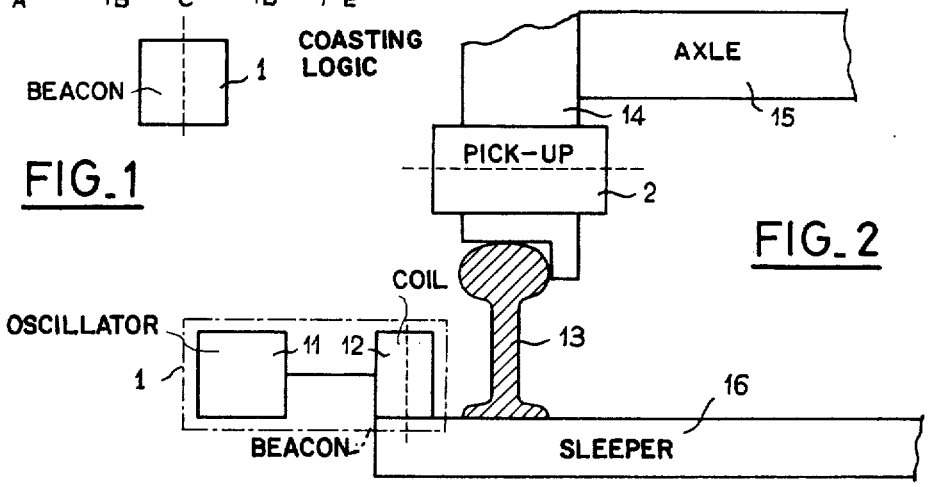
FIG. 2—a diagram representing the relative arrangement of the emitter beacon and the receiver coils.

FIG. 2 represents diagrammatically the relative positions of a beacon 1 and a pick-up 2. The beacon 1 comprises an oscillator 11 which delivers an alternating signal of predetermined frequency, for example, 20 kHz. This alternating signal is applied to a coil 12 having a vertical axis. This coil is attached to a sleeper, for example, 16 in the track, at a short distance from one of the running rails 13. The distance between the coil 12 and the rail 13 is of the order, for example, of about ten centimeters. The pick-ups 2, located in this example in front of the first axle 15, are arranged at a distance lying between five and fifteen centimeters above the rail 13.

Figure 3:
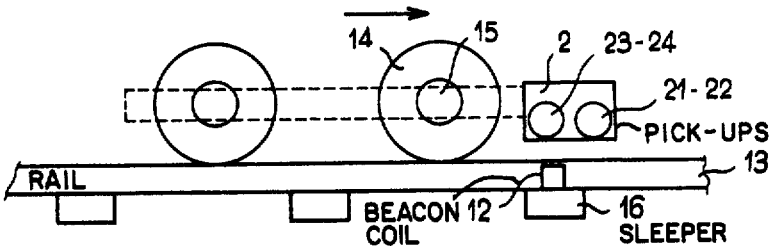
FIG. 3—a diagram showing the position of the receiver coils in front of the first bogie of the vehicle.

FIG. 3 shows a profile view of the same parts as FIG. 2. The cabinet containing the pick-ups 2 is located in front of the first axle 15 and of the first wheel 14 of the vehicle. This cabinet is assumed to be attached to the frame of the first bogie of the vehicle. The pick-ups are located preferably in the same cabinet as that for the track circuit pick-ups or for devices for reception of information. The group of coils 21-22 is located in front of the group of coils 23-24. The axes of the coils are horizontal and perpendicular to the running rails 13 so that these coils are insensitive to any current running through the rail 13. These coils can nevertheless pick-up the magnetic field emitted by the coil 12 of the beacon 1 because of numerous metallic parts which constitute the vehicle and which modify the direction of the lines of field in their presence.

Figure 4:
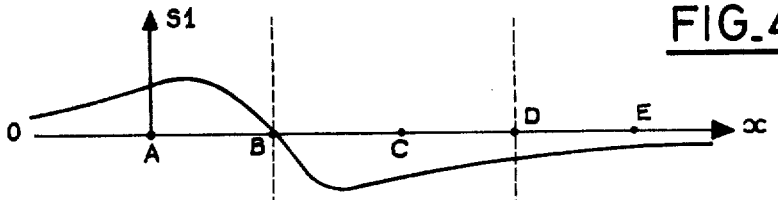
FIGS. 4, 5, 6 and 7—the form of the signals at different points in the circuits.

FIG. 4 is a curve representative of the amplitude and phase of the output signal from the filter 31. The points A,B,C,D and E on the axis OX correspond with different relative positions of the beacon 1 with respect to the pick-up unit 2. This curve represents in fact the variation as a function of the position of the beacon 1 of the amplitude and phase of the signals picked-up by the group of coils 21 and 22 located at the front of the pick-up unit 2. The change in sign of the curve corresponds with a rotation of phase by 180°. In proportion as the pick-ups approach the beacon, the amplitude of the signal $S_1$ increases and then diminishes in order to be cancelled at the instant when the axis of the beacon coincides with the axis of symmetry of the group of coils 21 and 22. Up to then the amplitude of the field picked up by the coil 21 was higher than that of the field picked up by the coil 22. Beyond the point B the difference between these amplitudes is reversed. This difference after a maximum decreases in proportion as the group 21-22 moves away from the beacon.

Figure 5:
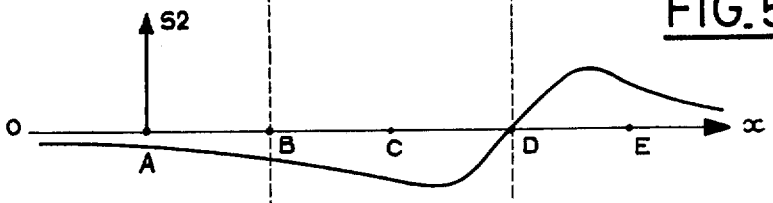

FIG. 5 represents the same curve of amplitude and phase relative to the group of coils 23 and 24. This time the phenomenon is produced in the reversed sense. In order to do that it is necessary for the order of connection of the coils of the group 23-24 to be the reverse of that of the coils of group 21-22. For example, as indicated in FIG. 1, the coil 21 is connected to the non-reversing input and the coil 22 to the reversing input to the amplifier 25 whilst the coil 23 is connected to the reversing input and the coil 24 to the non-reversing input to the amplifier 26.

Figure 6:
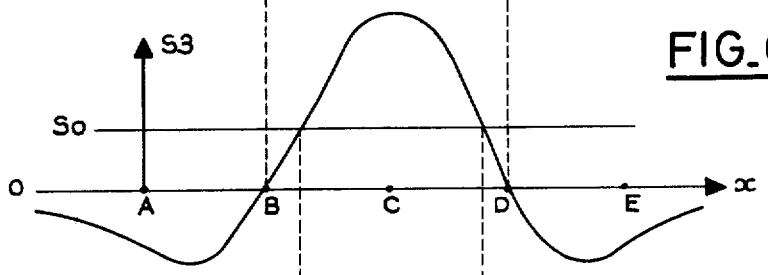

FIG. 6 represents the amplitude of the signal $S_3$ at the output from the multiplier circuit 33; this signal has a positive sign solely when the axis of the beacon is lying between the points B and D and a negative sign outside this zone. The comparison of this signal after detection with a threshold $S_o$ in the comparator 35 enables a logical signal to be obtained having two states, for example, a high state when the axis of the beacon is located within the zone located between the points B and D and a low state outside this zone.

Figure 7:
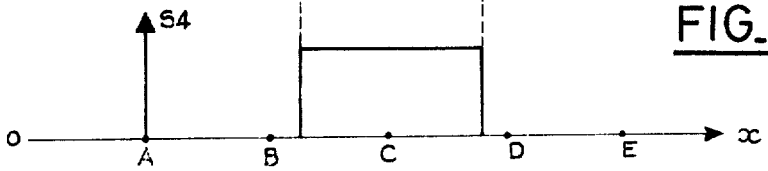

This logical signal $S_4$ at the output from the comparator 35 is represented in FIG. 7. An essential advantage of the present invention lies in the fact that the front and rear faces of this logical signal are strictly connected with the geometrical characteristics of the pick-up unit 2. It is thus possible to obtain an accuracy of location of the vehicle with respect to the beacon of centimeter order.

The invention is applicable in particular to automatic control of railway vehicles. Any number of beacons may be arranged along a track, and on board each vehicle filtering and detection units are connected to the pick-up unit 2. Each of these filtering and detection units delivers a logical signal at the moment of passing of the vehicle beside a beacon the frequency of which is equal to the central frequency of the bandpass filters of this unit. As indicated in FIG. 6 a logical signal may be used to control the setting of the vehicle to coasting, that is to say, the setting of the traction motors out of service. Other logical signals may be used to carry out programmed stopping of the vehicle. For example, a logical signal proceeding from a beacon controls the prepositioning of a counter into which is written a predetermined numerical value. This counter then receives subtractive pulses each time that one unit of distance is covered by the vehicle. The content of the counter is compared with one or more predetermined values and the result of the comparisons serves to control, for example, the reduction of speed of the traction motors and the braking device of the vehicle.

I claim:

1. A device for the detection of the position of a vehicle running on a railway track, characterized in that it includes:

at least one emitter beacon for emitting a beacon frequency, said beacon including a generator of alternating current and a coil having a vertical axis located at a predetermined point on the track, near to one of the running rails;

aboard the vehicle, near to one of the rails, a pick-up unit including two groups of two receiver coils the axes of which are horizontal and perpendicular to the running rail, the two coils of each group being connected in accordance with a differential system to the inputs to a differential amplifier means;

a filtering and detection unit connected to the outputs from the differential amplifier means, said unit including two bandpass filter circuits, the central frequency of which is equal to said beacon frequency, each filter circuit being connected to the output from said differential amplifier means;

circuit means for multiplying together the output signals from the two filter circuits; and circuit means for detecting and comparing output signals from the multiplying circuit means with a predetermined threshold in order to deliver a logical signal representative of the presence of said beacon frequency.

2. A detector device as in claim 1, wherein said differential amplifier means includes a first and second differential amplifier, each having non-inverting and inverting inputs and wherein in said pick-up unit the axes of the four receiver coils are located in one and the same substantially horizontal plane, the non-inverting and inverting inputs to the first differential amplifier being respectively connected to the coil located further forward and to the coil located less far forward of the first group, and the non-inverting and inverting inputs to the second differential amplifier being respectively connected to the coil located further back and to the coil located less far back of the second group, according to the normal direction of motion of the vehicle.

3. In a train control system wherein emitter beacons are located at predetermined points on the track near to one of the running rails, apparatus for the detection of the position of a vehicle running on the railway track comprising:

within each beacon, a radiating vertical-axis coil powered by an alternating current of a given frequency, and onboard the vehicle and positioned near said running rail, a pick-up unit including two pairs of receiver coils the axes of which are horizontal and perpendicular to the running rail, each pair of coils being connected in a differential way to the inputs of a differential amplifier means, the outputs of which are connected to at least one pair of band-pass filter circuits, each pair of said band-pass filter circuits being connected to the inputs of a multiplier circuit, said multiplier circuit generating a positive signal at its output when and only when said beacon is located between said two pairs of coils and the emitting frequency of said beacon is the central frequency of the said corresponding filter circuits.

4. Apparatus according to claim 3, wherein means are provided for comparing the output signal of said multiplier circuit with a predetermined threshold in order to deliver a logical signal.

5. Apparatus according to claim 3 wherein the axes of said pairs of receiver coils are located in one and the same substantially horizontal plane.

6. Apparatus according to claim 3 wherein said differential amplifier means comprises first and second differential amplifiers each having inverting and non-inverting inputs, and wherein the non-inverting and inverting inputs of the first differential amplifier are connected to the receiver coil further forward and to the coil located less far forward of the first pair, and the non-inverting and inverting inputs of the second amplifier are respectively connected to the coil located further back and to the coil located less far back of the second pair, according to the normal direction of motion of the vehicle.

* * * * *